US005610470A

United States Patent [19]

Wofsey

[11] Patent Number: 5,610,470

[45] Date of Patent: Mar. 11, 1997

[54] SPARK PLUG FOR AN INTERNAL COMBUSTION ENGINE

[76] Inventor: David Wofsey, 5287 W. Louisiana Ave., Lakewood, Colo. 80232

[21] Appl. No.: 364,175

[22] Filed: Dec. 27, 1994

Related U.S. Application Data

[63] Continuation-in-part of Ser. No. 91,153, Jul. 12, 1993.

[51] Int. Cl.[6] ..... H01T 13/20

[52] U.S. Cl. ..... 313/143; 313/120

[58] Field of Search ..... 313/141, 143, 313/120

[56] References Cited

U.S. PATENT DOCUMENTS

| | | | |
|---|---|---|---|
| 2,007,948 | 7/1935 | Field . | |
| 2,871,388 | 1/1959 | Adair | 313/141 |
| 2,894,162 | 7/1959 | Ignatjev | 313/141 |
| 2,944,178 | 7/1960 | Schaub | 313/141 |
| 4,015,160 | 3/1977 | Lara et al. . | |
| 4,023,058 | 5/1977 | Lara et al. . | |
| 4,028,576 | 6/1977 | Wofsey | 313/143 |
| 4,914,343 | 4/1990 | Kagawa et al. . | |
| 5,280,214 | 1/1994 | Johnson | 313/139 |

FOREIGN PATENT DOCUMENTS

| | | |
|---|---|---|
| 1948588 | 5/1970 | Germany . |
| 2346663 | 4/1974 | Germany . |
| 0256064 | 12/1927 | Italy . |
| 2027797 | 5/1979 | United Kingdom . |

*Primary Examiner*—Alvin E. Oberley
*Assistant Examiner*—Lawrence O. Richardson
*Attorney, Agent, or Firm*—J. Preston Oxenham

[57] ABSTRACT

A spark plug has a base with a bottom end portion adapted to be received and retained by a cylinder head of an internal combustion engine. An insulator retains a central electrode within the base with a combustion chamber end of the electrode extending into a combustion chamber of the engine when the plug is installed in the cylinder head. The central electrode combustion chamber end includes a combustion chamber end face with a hole having the physical characteristics of an acoustically tuned pipe with an open and a closed end formed in its surface. A ground electrode is attached to the base and defines a spark gap between its inner surface and the central electrode face. The ground electrode has a hole passing through it which has the physical characteristics of an acoustically tuned pipe with two open ends.

5 Claims, 6 Drawing Sheets

SPARK PLUG FOR AN INTERNAL COMBUSTION ENGINE

This application is a continuation-in-part of U.S. patent application Ser. No.08/091,153, filed 12 Jul. 1993 and titled (as amended) Improved Spark Plug for an Internal Combustion Engine and Method of Manufacture Thereof.

TECHNICAL FIELD

This invention relates to spark plugs for generating an electrical spark to initiate the combustion process in internal combustion type engines. More particularly, this invention relates to such spark plugs used in reciprocating, piston driven engines such as those commonly employed to power vehicles such as automobiles, motorcycles, boats, light aircraft and the like.

BACKGROUND OF THE INVENTION

Spark plugs have long been used to provide an electrical spark to initiate combustion in the combustion chambers of internal combustion engines. Most commonly, spark plugs of the prior art have been utilized in reciprocating piston gasoline fueled engines such as those commonly used to power passenger cars. Generally, these plugs have a lower portion which includes a base with external threads which engage inner threads of a receptacle port in the engine head such that, when the plug is in place, the base of the plug is in a combustion chamber of the engine at a location generally opposing the face of a piston. Typically, these plugs have a ground electrode at the bottom of the base and a central electrode extending from an insulated jacket above and opposing the ground electrode. A high voltage is applied to the electrode generally, just before the piston is in the top-dead-center position before the power stroke to initiate combustion of a compressed fuel air mixture provided in the combustion chamber.

DISCLOSURE OF THE INVENTION

It is an object of the present invention to provide an improved spark plug which will improve the combustion efficiency of reciprocating piston internal combustion engines in which it is installed.

A further object of the invention is to provide an improved spark plug which will reduce polluting emissions from internal combustion engines in which it is installed.

Another object of the present invention is to provide an improved spark plug which is easy to fabricate and inexpensive to manufacture.

A still further object of the present invention is to provide an improved spark plug assembly which will promote more complete combustion in internal combustion engines in which it is installed, improving the economy and performance of the engine, and providing improved reliability of operation.

Yet another object of the present invention is to provide an improved spark plug that generates a cleaning action during the combustion process which to reduce the accumulation of carbon and fuel deposits and thereby increase the efficiency and life of the engine.

A still further object of the present invention is to provide an improved spark plug which provides improved starting performance in unfavorable environmental conditions such as extreme cold and extreme heat.

A further object of the invention is to provide an improved spark plug that is self cleaning, and does not have a tendency to foul.

An additional object of the invention is to provide an improved spark plug that will increase the power output of an engine in which it is installed.

Another object of the present invention is to provide an improved spark plug assembly which will promote smooth and quiet engine performance.

A spark plug comprising an embodiment of the present invention includes a base having a bottom end portion adapted to be received and retained by the cylinder head of an internal combustion engine. An insulator retains a first electrode with a combustion chamber end extending into a combustion chamber of the engine when the plug is received and retained by the cylinder head. A second electrode is attached to the base end in set apart relation to the combustion chamber end of the first electrode to define a spark gap therebetween within the combustion chamber. The second electrode includes an inner surface defining a hole passing through it. In a preferred embodiment a surface of a face of the combustion chamber end of the first electrode defines a hole with a bottom such that the combustion chamber end face hole and the second electrode hole have a common axis. A spark plug comprising the invention may be fabricated by forming a hole in the base ground electrode and the face of the central electrode of a conventional prior art spark plug.

Further objects, aspects and advantages of the present invention will become apparent from the following description and claims, and from the accompanying drawings wherein:

DETAILED DESCRIPTION

Figure 1:
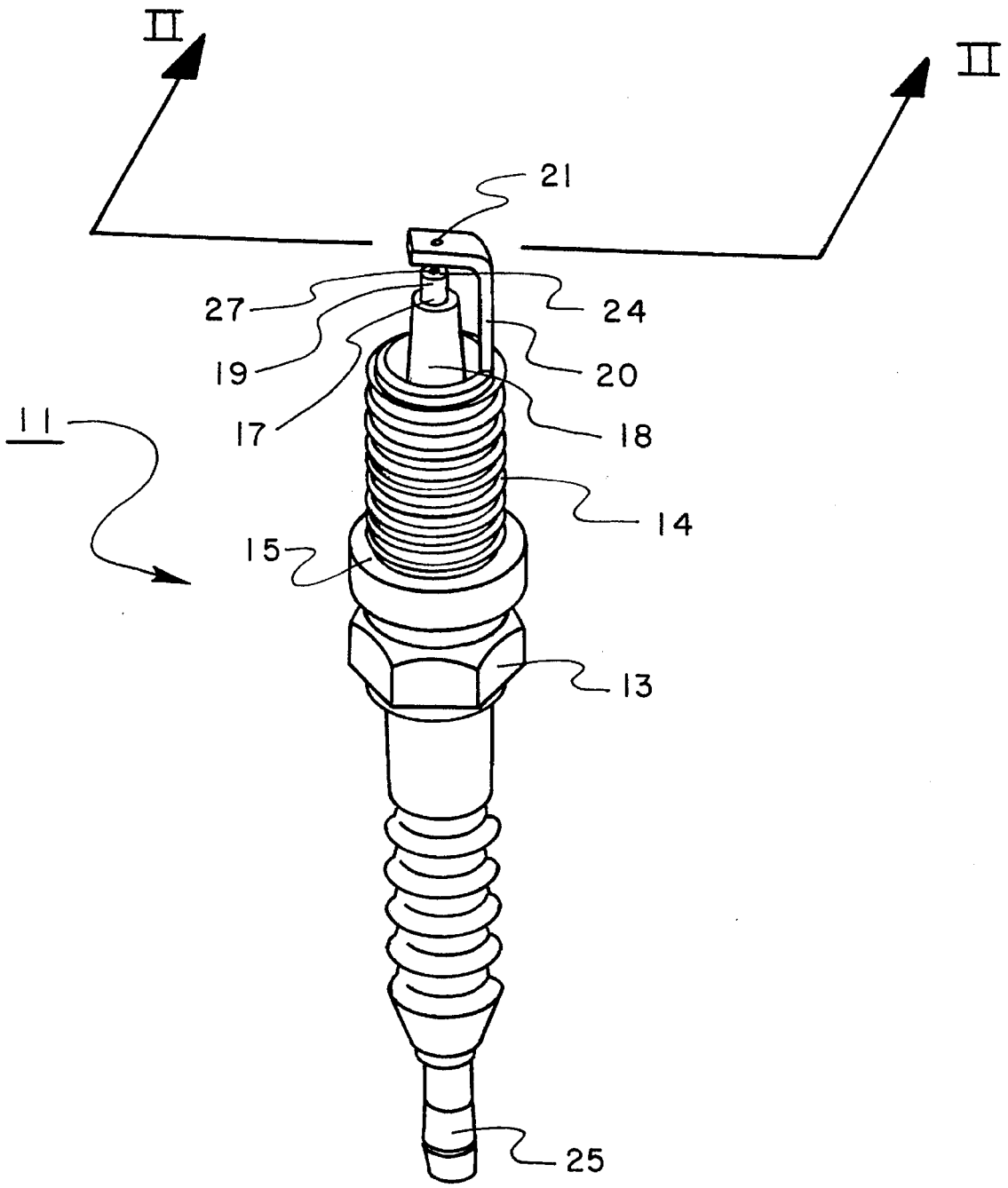
FIG. 1 is an isometric prospective view of the bottom of an improved spark plug assembly comprising a preferred embodiment of the present invention.

As shown in FIG. 1, spark plug assembly 11 comprising the present invention includes spark plug main body 12 which is made of metal and which is generally tubular. Main body 12 has hexagonal flange portion 13 for engagement by a suitable tool and is also provided with externally threaded bottom end portion 14 adapted to engage in an engine block. Annular sealing gasket 15 is provided at the top end of reduced externally threaded portion 14 disposed subjacent to the bottom surface of the shoulder beneath main body 12. Rigidly secured in body 12 is axially arranged insulator 16 formed of porcelain or the like and having downwardly tapering lower end portion 17. Rigidly secured axially within insulator 16 is vertical conductor rod 18 with an upper exposed end including standard connection terminal 25. A lower end of conductor rod 18 projects below the bottom end of insulator tapered portion 17 and defines exposed rod-like central electrode end portion 19.

Figure 2:
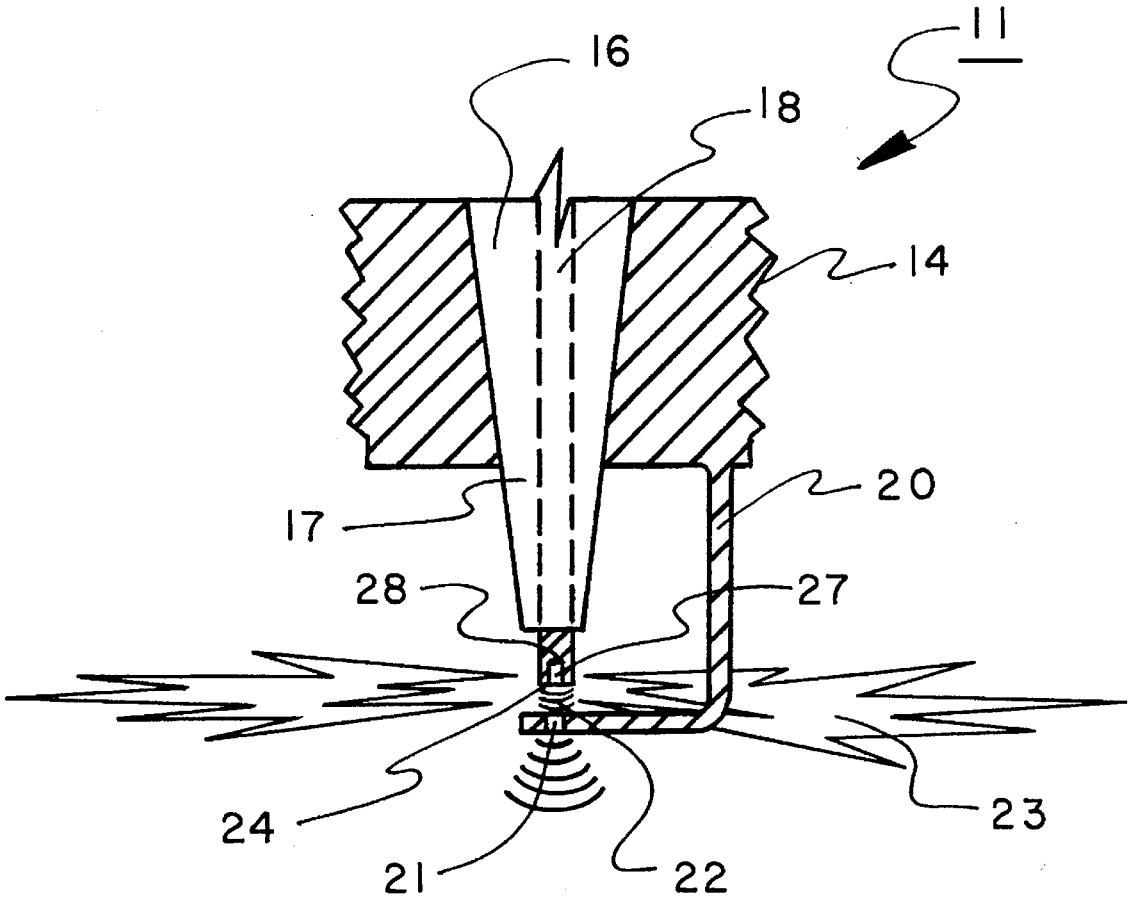
FIG. 2 is a partial cross-sectional view of the spark plug assembly of FIG. 1 taken on line II—II.

Performance of spark plug assembly 11 is enhanced by initial interaction of the ignition flame with central electrode hole 27 and base electrode through hole 21 which act as tuned pipes to generate ultra-sonic and acoustic vibrations during ignition and combustion, as may be understood with reference to FIG. 2. FIG. 2 is a partial vertical cross-sectional view of spark plug assembly of FIG. 1 taken substantially on line II—II. Conductor rod 18 is insulated from main body 12 by insulator 16 including downwardly tapered portion 17. Exposed electrode 19 forms spark gap 22 with an end portion of "L" shaped ground electrode 20. Through hole 21 is formed in ground electrode 20. Hole 27 with closed bottom 28 is formed in face 24 of central electrode 19. At the instant of ignition, sparked flame projection 23 is established in the combustible fuel-air mixture. Flame projection 23 rapidly passes across through hole 21. Through hole 21 has the physical acoustic characteristic of a tuned pipe that is open on both ends and enhances the propagation of ultra-sonic and acoustic resonant vibrations. Hole 27 in face 24 has the physical acoustic characteristic of a tuned pipe that is closed at one end and open at the other and also enhances the propagation of ultra-sonic and acoustic resonant vibrations.

Figure 3:
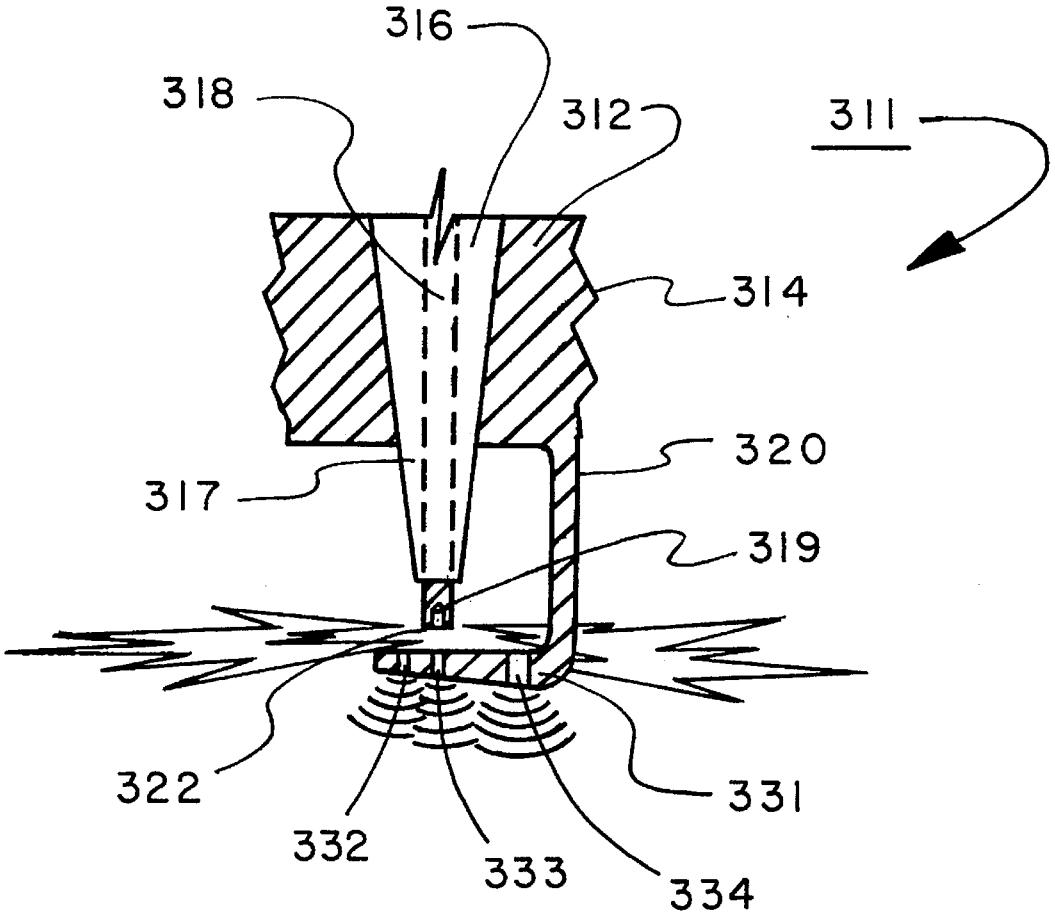
FIG. 3 a partial cross-sectional view of a spark plug assembly comprising an alternative embodiment of the present invention.

Ground electrode 320 of spark plug assembly 311 of FIG. 3 comprising another embodiment of the present invention includes lower section 331 with three through holes. Through hole 332, the shortest length through hole, enhances the highest frequency resonance vibrations; through hole 333 enhances mid-frequency resonance vibrations; and through hole 334, the longest through hole, enhances the lowest frequency resonance vibrations.

Figure 4:
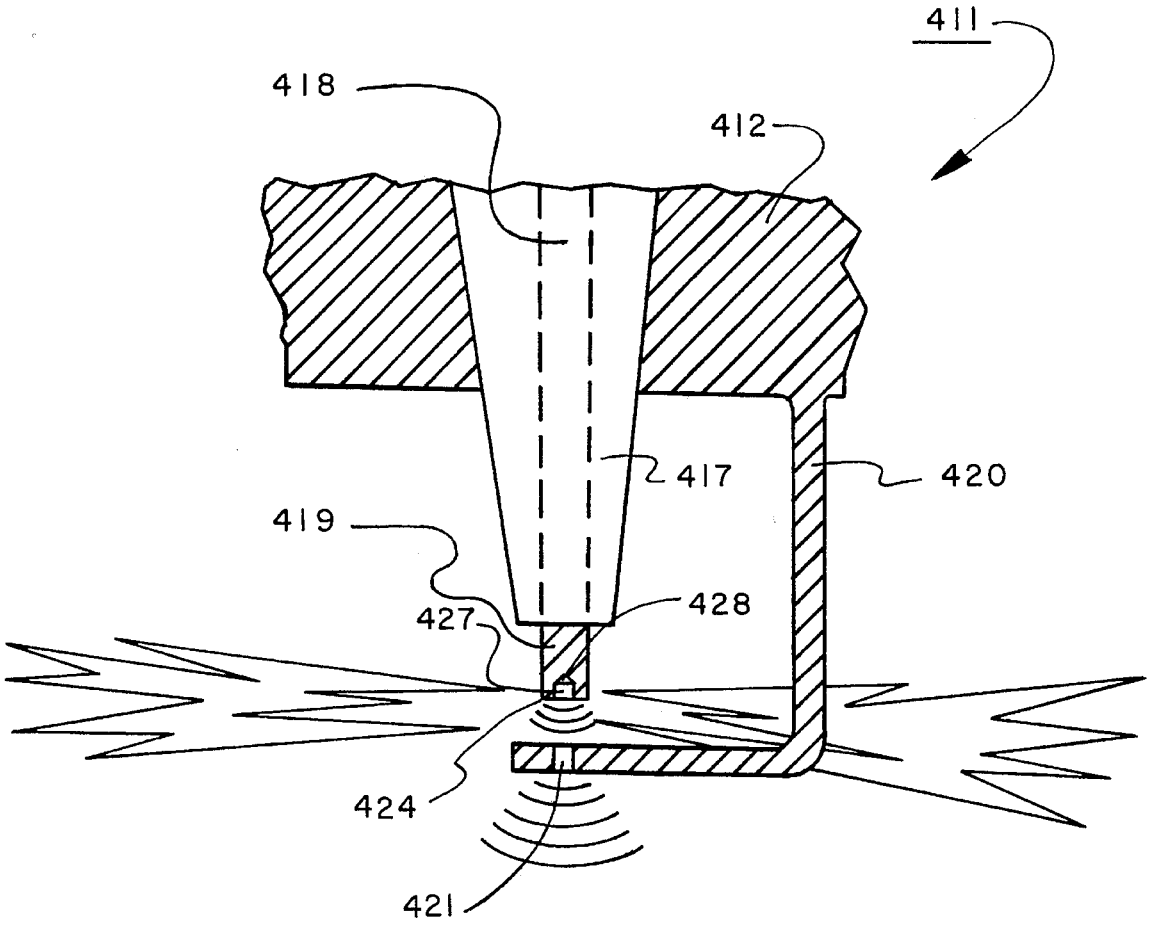
FIG. 4 is a partial cross-sectional view of a spark plug assembly comprising another alternative embodiment of the present invention.
Figure 5:
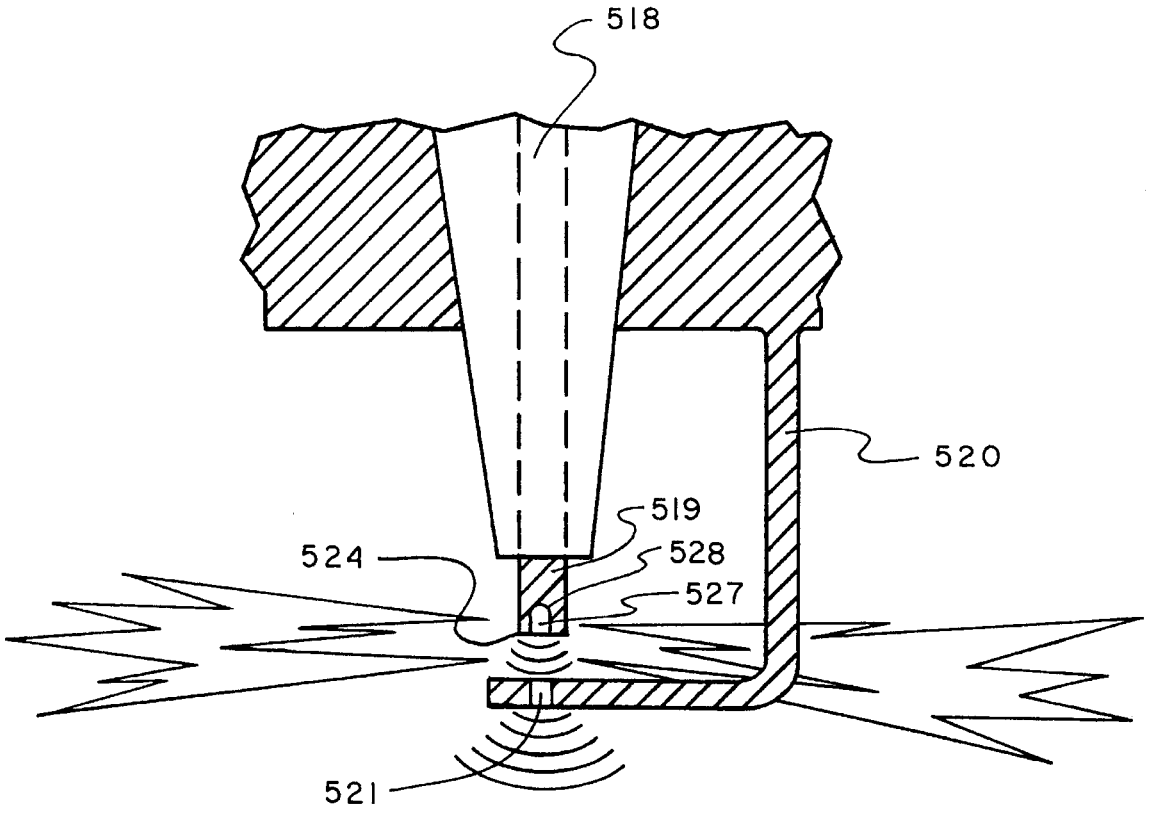
FIG. 5 is a partial cross-sectional view of a spark plug assembly comprising another alternative embodiment of the present invention.
Figure 6:
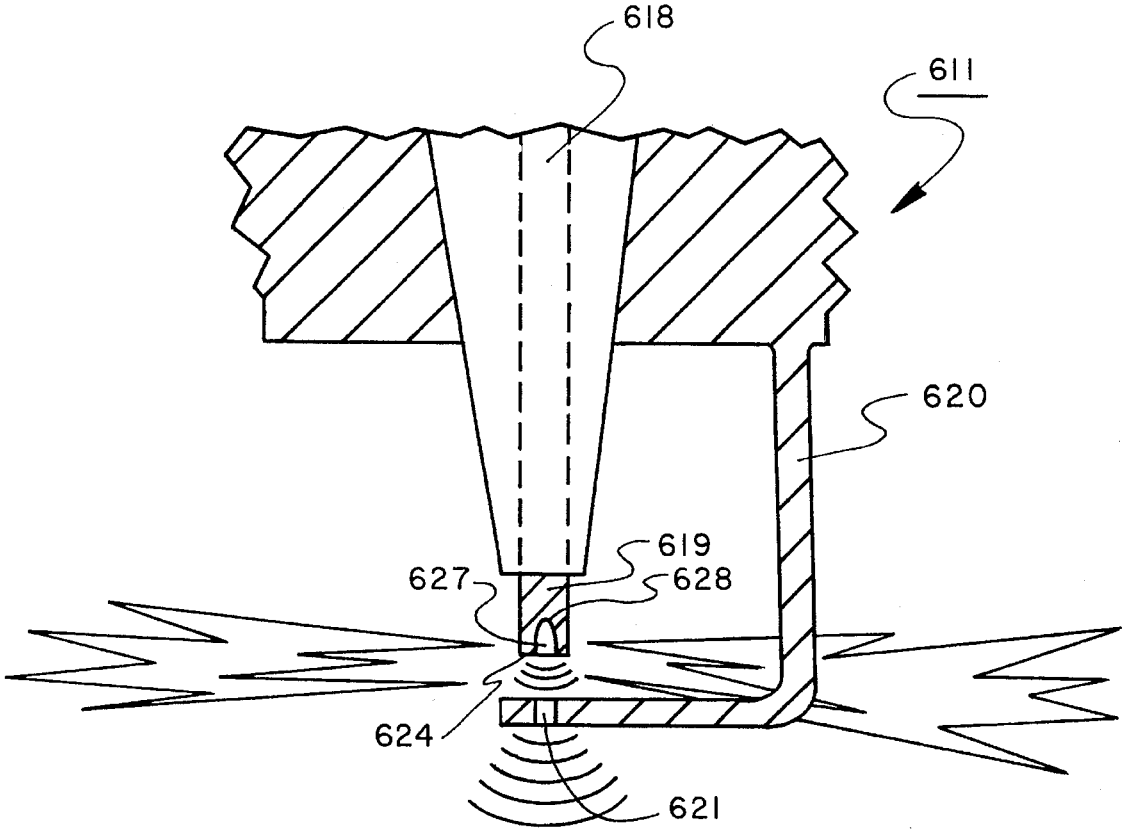
FIG. 6 is a partial cross-sectional view of a spark plug assembly comprising another alternative embodiment of the present invention.

The shape of the bottom of the hole formed on the face of the central electrode may be selected to maximize pressure variation at the mouth of the hole and focus flame propagation to enhance engine performance. Spark plug assembly 411 of FIG. 4 comprises an alternative embodiment of the present invention in which bottom 428 of hole 427 is of conical shape. FIG. 5 illustrates an alternative embodiment in which hole bottom 528 is hemispherical. Bottom 628 of the alternative embodiment of FIG. 6 has a parabolic cross section.

To those familiar with the art, it will be readily apparent that a spark plug assembly comprising an embodiment of the present invention may be fabricated by performing common machining operations upon conventional spark plug assemblies of the prior art. For example, spark plug assembly 11 of FIG. 1, may be fabricated from a standard spark plug by drilling a hole through "L"shaped ground electrode 20 and passing the drill on through face 24 of electrode 19 to a selected depth to form central hole 27.

The physical principle of the present invention may be modeled by well known mathematical formulas for the fundamental and resonant vibrations of organ pipes. The fundamental and resonant frequencies of vibration for a through hole in a base electrode may be found from formulas for the fundamental and harmonic frequencies of vibration of a pipe open at both ends:

$$f=nV/2l$$

Where:

f≡frequency in cycles per second

V≡velocity of sound in feet/second l≡length of pipe in feet n≡an integer and n≧1.

This formula shows that the resonant frequencies are odd and even harmonics of a fundamental frequency.

As an example which is directly applicable to a through hole of this invention, assuming that:

a. the velocity of sound in the burning gas in the combustion cylinder is 1300 ft/sec;

b. the length of through hole 21 in "L" shaped ground electrode 20 of spark plug assembly 11 of FIG. 1 is 0.00517 ft.(0.062 in.); and, c. the value of n=1 (for the fundamental frequency):

the fundamental frequency of a through hole may be estimated to be about $$f_1=(1\times1300\text{ ft/sec})/(2\times0.00517\text{ ft})$$

$$f_1=125{,}725.3\text{ Hertz ,or,}$$

$$f_1=125\text{ Kilo Hertz.}$$

The harmonic frequencies of the through hole are then n×125. Kilo Hertz where n>1:

$$f_2=2\times125\text{ Kilo Hertz}=250\text{ Kilo Hertz}$$

$$f_3=3\times125\text{ Kilo Hertz}=375\text{ Kilo Hertz}$$

.

.

.

$$f_{10}=10\times125\text{ Kilo Hertz}=1.250\text{ Mega Hertz.}$$

The fundamental and resonant frequencies of vibration for a closed bottom hole in a central electrode may found from formulas for the fundamental and harmonic frequencies of vibration of a pipe closed at one end and open at the other end:

$$f=nV/4l$$

Where:

f≡frequency in cycles per second v≡velocity of sound in feet/second l≡length of pipe in feet n≡an odd integer and n≧1.

This formula shows that the resonant frequencies are odd harmonics of a fundamental frequency.

As an example which is directly applicable to a central electrode hole of this invention, assuming that:

a. the velocity of sound in the burning gas in the combustion cylinder is 1300 ft/sec;

b. the depth of hole 27 of center electrode 19 of spark plug assembly 11 of FIG. 1 is 0.00208 ft. (0.025 in.); and, c. the value of n=1(for the fundamental frequency):

the fundamental frequency may be estimated as about $$f_1=(1\times1300\text{ ft/sec})/(4\times0.00208\text{ ft})$$

$$f_1=156\text{ Kilo Hertz.}$$

The harmonic frequencies are then n×156. Kilo Hertz where n is an odd integer >1:

$f_2 = 3 \times 156$ Kilo Hertz = 468 Kilo Hertz $f_3 = 5 \times 156$ Kilo Hertz = 781 Kilo Hertz

.

.

.

$f_{10} = 19 \times 125$ Kilo Hertz = 2.969 Mega Hertz.

While exemplary spark plugs comprising specific embodiments of the invention have been disclosed in the foregoing description, it will be understood that the invention is not limited to those embodiments and various modifications within the spirit of the invention may occur to those skilled in the art, particularly in light of the foregoing teachings. For example, a through hole in a ground electrode may have a longitudinal axis which is not normal to a longitudinal axis of the ground electrode and may be of a diameter different from that of a hole in the central electrode. It is, therefore, contemplated by the appended claims to cover any such modification which incorporates the essential features of this invention or which encompasses the spirit and scope of the invention.

I claim:

1. In a spark plug having a first electrode and a second electrode defining a spark gap there between, the improvement comprising:

the first electrode has a face and a surface of said face forms a hole with a bottom said hole having the physical characteristics of an acoustically tuned pipe closed at one end; and, the second electrode includes an inner surface, said inner surface defining a hole passing through the second electrode said hole having the physical characteristics of an acoustically tuned pipe open at both ends.

2. The improvement of claim 1, in which said inner surface and said face surface have a common central axis.

3. The improvement of claim 2, in which the first electrode has a longitudinal first electrode axis, further comprising:

said inner surface axis is coincident with the first electrode axis.

4. A spark plug comprising:

a base, said base having a bottom end portion adapted to be received and retained by a cylinder head of an internal combustion engine;

a first electrode with a combustion chamber end including a combustion chamber end face, said end face having a surface including a hole defining portion defining a hole with a bottom said hole having the physical characteristics of an acoustically tuned pipe with an open and a closed end;

an insulator for retaining said first electrode within said base with said combustion chamber end extending into a combustion chamber of the engine when said plug is received and retained by the cylinder head; and, a second electrode attached to said base end in set apart relation to said combustion chamber end face to define a spark gap therebetween, said second electrode including an inner surface defining a hole passing through said second electrode said hole having the physical characteristics of an acoustically tuned pipe having two open ends.

5. A spark plug as in claim 4, further comprising: p1 said hole defining surface portion and said inner surface surround a common axis.

* * * * *